United States Patent [19]

Miller

[11] Patent Number: 4,627,908

[45] Date of Patent: Dec. 9, 1986

[54] PROCESS FOR STABILIZING LUBE BASE STOCKS DERIVED FROM BRIGHT STOCK

[75] Inventor: Stephen J. Miller, San Francisco, Calif.

[73] Assignee: Chevron Research Company, San Francisco, Calif.

[21] Appl. No.: 790,704

[22] Filed: Oct. 24, 1985

[51] Int. Cl.[4] ..... C10G 65/08; C10G 65/12

[52] U.S. Cl. ..... 208/58; 208/18; 208/97; 208/143; 208/254 H

[58] Field of Search ..... 208/57, 58, 18, 95, 208/97, 89, 254 H, 143

[56] References Cited

U.S. PATENT DOCUMENTS

| | | | |
|---|---|---|---|
| 3,317,419 | 5/1967 | Fortman | 208/58 |
| 3,486,993 | 12/1969 | Egan et al. | 208/89 |
| 3,617,475 | 11/1971 | Offutt et al. | 208/18 |
| 3,642,610 | 2/1972 | Divijak, Jr. et al. | 208/57 |
| 3,666,657 | 5/1972 | Thompson et al. | 208/18 |
| 3,852,207 | 12/1974 | Stangeland et al. | 208/58 |
| 3,904,513 | 9/1975 | Fischer et al. | 208/18 |
| 4,162,962 | 7/1979 | Stangeland | 208/58 |
| 4,263,127 | 4/1981 | Rausch et al. | 208/18 |
| 4,294,687 | 10/1981 | Pinaire et al. | 208/58 |
| 4,325,804 | 4/1982 | Everett et al. | 208/18 |
| 4,414,097 | 11/1983 | Chester et al. | 208/18 |

*Primary Examiner*—Andrew H. Metz
*Assistant Examiner*—Anthony McFarlane
*Attorney, Agent, or Firm*—W. K. Turner; G. D. Haynes; V. J. Cavalieri

[57] ABSTRACT

A process for stabilizing a lubricating oil base stock derived from a nitro-aromatic-containing hydrocracked bright stock, comprising a two-step stabilizing process utilizing hydrodenitrification followed by mild hydrofinishing.

14 Claims, No Drawings

PROCESS FOR STABILIZING LUBE BASE STOCKS DERIVED FROM BRIGHT STOCK

BACKGROUND OF THE INVENTION

This invention relates to a process for improving the bulk oxidation stability and storage stability of lube oil base stocks derived from hydrocracked bright stock.

The term "oxidation stability" refers to the resistance of the oil to oxygen addition, in other words, how rapidly is oxygen picked up by and added to molecular species within the oil. Oxidation stability is indicated by the oxidator BN measured in hours. Oxidator BN is thoroughly described in U.S. Pat. No. 3,852,207 granted Dec. 3, 1974 to B. E. Stangeland et al at column 6, lines 15–30. Basically, the test measures the time required for 100 grams of oil to absorb one liter of oxygen. The term "storage stability" refers to the resistance of the oil to floc formation in the presence of oxygen.

The process comprises two steps. In the first step a hydrocracked bright stock is hydrodenitrified to reduce its heteroatom, particularly nitrogen, content using, for example, a sulfided nickel-tin catalyst having a siliceous matrix or a nickel-molybdenum hydrotreating catalyst having an alumina matrix. In the second step, the hydrocracked bright stock, having a reduced nitrogen content, is hydrofinished using, for example, an unsulfided nickel-tin or palladium hydrotreating catalyst having a siliceous matrix.

Both steps are carried out at an unusually low liquid hourly space velocity (LHSV), about 0.25 $Hr^{-1}$. In the first step, a low LHSV permits the desired hydrodenitrification reaction to proceed at relative low temperatures, about 700° F. Under these conditions hydrocracking is minimized. In the second step a low LHSV permits thorough saturation of aromatics which are floc-forming species. Thus, in general, the first step removes nitrogen and sulfur, known catalyst poisons, and improves oxidation stability; and the second step saturates aromatic floc precursors, and improves storage stability. Accordingly, it has been found that the stability of the resultant lube oil base stock is significantly improved.

Lubricant refining is based upon the fact that crude oils, as shown by experience or by assay, contain a quantity of lubricant base stocks having a predetermined set of properties such as, for example, appropriate viscosity, oxidation stability, and maintenance of fluidity at low temperatures. The process of refining to isolate a lubricant base stock consists of a set of unit operations to remove or convert the unwanted components. The most common of these unit operations include, for instance, distillation, hydrocracking, dewaxing, and hydrogenation.

The lubricant base stock, isolated by these refining operations, may be used as such as a lubricant, or it may be blended with another lubricant base stock having somewhat different properties. Or, the base stock, prior to use as a lubricant, may be compounded with one or more additives which function, for example, as antioxidants, extreme pressure additives, and viscosity index improvers. As used herein, the term "stock", regardless whether or not the term is further qualified, refers to a hydrocarbon oil without additives. The term "dewaxed stock" will refer to an oil which has been treated by any method to remove or otherwise convert the wax contained therein and thereby reduce its pour point. The term "base stock" will refer to an oil refined to a point suitable for some particular end use, such as for preparing automotive oils.

In general, refineries do not manufacture a single lube base stock but rather process at least one distillate fraction and one residuum fraction to produce several lube base stocks. Typically, three distillate fractions differing in boiling range and the residuum of a vacuum distillation operation are refined. These four fractions have acquired various names in the refining art, the most volatile distillate fraction often being referred to as the "light neutral" oil. The other distillates are called "medium neutral" and "heavy neutral" oils. The residuum fraction, is commonly referred to as "bright stock". Thus, the manufacture of lubricant base stocks involves a process for producing a slate of base stocks, which slate may include a bright stock.

Processes have been proposed to produce lubricating oil base stocks by refining bright stocks. Most such refining processes require hydrocracking the bright stock to produce a hydrocrackate which is in turn dewaxed to produce a dewaxed bright stock. The problem is that lubricating oil base stocks derived from hydrocracked stocks are unstable in the presence of oxygen and light.

Various stabilizing steps have been proposed. U.S. Pat. Nos. 3,189,540, 3,256,175 granted June 15, 1965 and June 14, 1966, respectively, to Kozlowski et al, describe a typical stabilization. The proposed stabilization uses a series of process steps employing a severe catalytic hydrogenation step to convert the remaining aromatic constituents into desirable lubricating oil constituents.

The goal of hydrogenation is to hydrogenate the unstable species, which are thought to be partially saturated polycyclic compounds. Unfortunately, severe hydrogenation of hydrocracked bright stocks not only hydrogenates the undesirable polycyclic constituents, but also further hydrocracks desirable constituents resulting in the loss of valuable lubricant base stock. Thus, recent processing schemes have suggested several alternatives to severe hydrogenation.

Refiners often now use mild hydrogenation (sometimes referred to as hydrofinishing) to produce more stable lubricating oils. Obviously, mild hydrogenation requires a compromise between the desired stabilization and the undesired hydrocracking. Consequently, thorough stabilization is often not accomplished. As an alternative to hydrofinishing, stabilizing agents, such as olefins, alcohols, esters, or alkylhalides can be added to the hydrocracked base stock in the presence of acidic catalysts having controlled alkylation activity. The resulting alkylation stabilizes the aromatic floc formers. While these and other processing schemes have achieved some success, in the case of highly aromatic stocks, such as bright stock, none of the previously known schemes is entirely satisfactory.

Thus, in general, at the time of the present invention, the literature relating to lube oil stabilization taught the use of severe hydrogenation or, alternatively, mild hydrofinishing and/or alkylation to stabilize a hydrocracked bright stock. However, in spite of the large amount of research into developing lubricant base stocks and stabilizing them, there continues to be intensive research into developing a more efficient and more convenient method for achieving those goals, especially for lubricant base stocks derived from hydrocracked bright stocks. The object of the present invention is to provide such a process.

It has now been discovered that a two-step hydrogenation process comprising a first step to reduce the nitrogen and sulfur content and a second step to thoroughly hydrogenate unstable polycyclics will produce a more stable lubricating oil base stock from hydrocracked bright stock. Thus, rather than employing a single severe hydrogenation step, the present invention employs a relatively milder two-step hydrofinishing stabilization for hydrocracked bright stocks.

SUMMARY OF THE INVENTION

The discovery of the present invention is embodied in an improved process for stabilizing a lube base stock derived from hydrocracked bright stock, comprising:

(a) contacting said hydrocracked bright stock with hydrogen in the presence of a catalyst having hydrodenitrification activity under conditions, including a low LHSV, effective to reduce the nitrogen content of said bright stock to less than about 50 ppm by weight, preferably less than 10 ppm by weight, and most preferably less than 3 ppm; and (b) contacting the denitrified product of step (a) with hydrogen in the presence of a catalyst having hydrogenation activity under conditions, including a low LHSV, effective to reduce the level of unsaturated polycyclic compounds to produce a lubricant base stock.

DETAILED DESCRIPTION

The hydrocarbonaceous feeds from which the hydrocracked bright stocks used in the process of this invention are obtained usually contain aromatic compounds as well as normal and branched paraffins of very long chain lengths. These feeds usually boil in the gas oil range. Preferred feedstocks are vacuum gas oils with normal boiling ranges above about 350° C. and below about 600° C., and deasphalted residual oils having normal boiling ranges above about 480° C. and below about 650° C. Reduced topped crude oils, shale oils, liquefied coal, coke distillates, flask or thermally cracked oils, atmospheric residua, and other heavy oils can also be used as the feed source.

Typically, the hydrocarbonaceous feed is distilled at atmospheric pressure to produce a reduced crude (residuum) which is then vacuum distilled to produce a distillate fraction and a vacuum residuum fraction. According to the present process the residuum fraction is then hydrocracked using standard reaction conditions and catalysts in one or more reaction zones. The resulting hydrocracked bright stock can be further refined, for instance dewaxed, or used as such as the feed stock to the two-step process of this invention.

In the first step of the present process, the hydrocracked bright stock is hydrodenitrified to reduce its nitrogen level. Conventional hydrodenitrification catalysts and conditions can be used when carrying out this step. However, in order for the second step, detailed below, to achieve complete, or nearly complete aromatic saturation, of the hydrocracked bright stock which is essential to the present process; in the first step a combination of catalysts and hydrogenation conditions which will reduce the nitrogen level of the hydrocracked bright stock to below about 50 ppm by weight without substantially increasing the quantity of aromatic unsaturates by hydrocracking side reactions are essential. In addition, it will be desirable to select catalysts and conditions which inherently result in cleavage of carbon-sulfur bonds with formation of hydrogen sulfide to achieve some level of hydrodesulfurization. Organic sulfur, like nitrogen, is deleterious to the activity of the hydrogenation catalysts used in the second step. It is desirable to reduce the sulfur level to less than about 50 ppm, preferably less than about 10 ppm, and most preferably less than about 3 ppm. Typical first step hydrodenitrification catalysts comprise a Group VIIIA metal, such as nickel or cobalt, and a Group VIA metal, such as molybdenum or tungsten (unless otherwise noted references to the Periodic Table of Elements are based upon the IUPAC notation) with an alumina or siliceous matrix. These and other hydrodenitrification catalysts, such as nickel-tin catalysts, are well known in the art. U.S. Pat. No. 3,227,661 granted Jan. 4, 1966 to Jacobson et al, describes a method which may be used to prepare a suitable hydrodenitrification catalyst.

Typical hydrodenitrification conditions which are useful in the first step of the present process vary over a fairly wide range, but in general temperatures range from about 600° F. to about 850° F., preferably from about 650° F. to 800° F., pressures range from about 500 psig to about 4000 psig, preferably from about 1500 psig to about 3000 psig, contact times expressed as LHSV range from about 0.1 per hour to about 3 per hour, preferably from about 0.1 per hour to about 0.8 per hour, and hydrogen rates range from about 5000 cu. ft. per barrel to about 15,000 cu. ft. per barrel. U.S. Pat. No. 3,227,661 describes those conditions required for various processing schemes using the denitrification catalysts taught in that patent. A general discussion of hydrodenitrification is available in U.S. Pat. No. 3,073,221 granted on Feb. 19, 1963 to Beuther et al. As previously discussed, the overlying consideration, when selecting suitable denitrification conditions from the general conditions taught in these patents and the art generally, is the use of a relatively low LHSV and temperature in order to achieve nearly complete denitrification with minimal hydrocracking.

In the second step of the present process the denitrified, "clean" stock is hydrofinished using a mild hydrogenation catalyst and conditions. Suitable catalysts can be selected from conventional hydrofinishing catalysts having hydrogenation activity. Since this step can also be carried out under relatively mild conditions when a low LHSV is employed, it is preferable to use a hydrogenation catalyst such as, for example, a noble metal from Group VIIIA, such as palladium, on a refractory oxide support, or unsulfided Group VIIIA and Group VI, such as nickel-molybdenum, or nickel-tin catalysts. U.S. Pat. No. 3,852,207 granted on Dec. 3, 1974 to Stangeland et al, describes suitable noble metal catalysts and mild conditions.

As mentioned already, suitable hydrofinishing conditions should be selected to achieve as complete hydrogenation of unsaturated aromatic as possible. Since the first step has removed the common hydrogenation catalyst poisons, the second step run length can be relatively long affording the opportunity to use a relatively low LHSV and mild conditions. Suitable conditions include a temperature ranging from about 300° F. to about 600° F., preferably from about 350° F. to about 550° F., a pressure ranging from about 500 psig to about 4000 psig, preferably from about 1500 psig to about 3000 psig, and an LHSV ranging from about 0.1 to about 2.0 per hour, preferably from about 0.1 per hour to about 0.5 per hour. Thus, in general terms the clear hydrodenitrified effluent of the first step is contacted with hydrogen in the presence of a hydrogenation catalyst under mild hydrogenation conditions. Other suitable catalysts are detailed, for instance in U.S. Pat. No. 4,157,294 granted June 5, 1979 to Iwao et al and U.S. Pat. No. 3,904,513, granted Sept. 9, 1975 to Fischer et al, both incorporated herein by reference.

The product of the process of the present invention is suitable for use as a lubricant base stock. Typically, it is dewaxed, if that has not already been done, prior to final blending.

The present invention is exemplified below. The examples are intended to illustrate representative embodiments of the invention and results which have been obtained in laboratory analysis. Those familiar with the art will appreciate that other embodiments of the invention will provide equivalent results without departing from the essential features of the invention.

Examples

EXAMPLE 1

In a single step stabilization carried out for comparison with the two-step process of the present invention, a solvent dewaxed hydrocracked bright stock (Table I) was hydrofinished over a sulfided nickel-tin on silica-alumina hydrogenation catalyst at 705°-716° F., 0.25 LHSV, 2200 psig, and 8M SCF/bbl $H_2$. At 1080 hours onstream and 716° F., conversion below 900° F. was 22 wt. %. Product sulfur was 33 ppm and nitrogen 6.7 ppm. The product was tested for storage stability by placing 40 cc. of oil in an unstoppered cylindrical glass bottle of 1⅜ inches diameter and putting the bottle in a forced convection oven controlled at 250° F. The sample was examined once per day for floc. The test was ended when a moderate to heavy floc could be observed. The product formed heavy floc within one day. The oxidator BN was 4.6 hours.

In order to illustrate the two-step process of the present invention and obtain a comparison with the single step process described above, the denitrified product from Example 1 was subjected to a second hydrofinishing over a catalyst composed of 2 wt. % palladium on silica-alumina. Hydrofinishing conditions were 0.25 LHSV, 400° F., 2200 psig, and 8M SCF/bbl $H_2$. The 250° F. storage stability of the product from 0-500 hours onstream was 15+ days, and the oxidator BN was 20.0 hours demonstrating the significant benefit of the two-stage process.

EXAMPLE 2

In a second comparison with the single step process of Example 1, the denitrified product from Example 1 was subjected to a second hydrofinishing over the palladium catalyst of Example 1, and at the same conditions except for an LHSV of 1.0. After 48 hours onstream, the product had a 250° F. storage stability of 4 days, demonstrating the importance of low LHSV to successfully stabilize the bright stock.

EXAMPLE 3

In another comparative test, the dewaxed hydrocracked bright stock feed (Table I) was hydrofinished over a sulfided Ni-Mo on alumina hydrogenation catalyst at 0.5 LHSV, 760°-767° F., 2200 psig, and 8M SCF/bbl $H_2$ for 584 hours. At 584 hours onstream and a catalyst temperature of 767° F., conversion below 900° F. was 26 wt. %. Product sulfur was 4.6 ppm and nitrogen 73 ppm. The product samples were combined and tested for 250° F. storage stability, which was found to be less than one day.

The first stage run with Ni-Mo on alumina described above was continued for another 600 hours, but at an LHSV of 0.25 and a catalyst temperature of 742° F. Conversion below 900° F. was 27 wt. %. Product sulfur was 1.8 ppm and nitrogen 17 ppm, well below that achievable at 0.5 LHSV and the same conversion. The 250° F. storage stability was less than one day. This product was then hydrofinished in a second stage over a fresh charge of the $Pd/SiO_2$-$Al_2O_3$ catalyst of Example 1 at 0.25 LHSV, 350° F., 2200 psig, and 8M SCF/bbl $H_2$. After 182 hours, the 250° F. storage stability was 15+ days.

TABLE I

| Dewaxed Hydrocracked Bright Stock Inspections | |
|---|---|
| Gravity, °API | 21.8 |
| Sulfur, ppm | 970 |
| Nitrogen, ppm | 980 |
| Pour Point, °F | +10 |
| Viscosity, cSt, 40°C | 1148.0 |
| Distillation, LV%, °F. | |
| ST/5 | 990/1019 |
| 10/30 | 1034/1067 |
| 50 | 1093 |
| Oxidator BN, hr. | 2.5 |

What is claimed is:

1. An improved process for stabilizing a nitro-aromatic-containing lubricating oil base stock derived from a hydrocracked bright stock, comprising:
   (a) contacting said hydrocracked bright stock with hydrogen in the presence of a catalyst having hydrodenitrification activity under conditions effective to reduce the nitrogen content of said stock and to minimize cracking to produce a substantially nitrogen-free product; and
   (b) contacting said substantially nitrogen-free product with hydrogen in the presence of a catalyst having hydrogenation activity under mild conditions to produce a stabilized lubricating oil base stock having improved oxidation stability as shown by oxidator BN.

2. A process according to claim 1 wherein the catalyst having hydrodenitrification activity comprises at least metal from Group VIIIA and at least one metal from Group VIA or tin supported on an alumina or siliceous matrix.

3. A process according to claim 2 wherein said Group VIIIA metal is nickel or cobalt and said Group VIA metal is molybdenum or tungsten.

4. A process according to claim 3 wherein said catalyst is sulfided.

5. A process according to claim 1 wherein said hydrodenitrification is carried out at a temperature ranging from about 600° F. to about 850° F., a pressure ranging from about 500 psig to about 4000 psig, an LHSV ranging from about 0.1 $hr.^{-1}$ to about 3 $hr.^{-1}$, and a substantial hydrogen partial pressure.

6. A process according to claim 5 wherein said LHSV is from about 0.1 $hr.^{-1}$ to about 0.8 $hr^{-1}$.

7. A process according to claim 6 wherein said LHSV is about 0.25 $hr.^{-1}$.

8. A process according to claim 1 wherein said catalyst having hydrogenation activity comprises at least one Group VIIIA noble metal supported on a refractory oxide.

9. A process according to claim 8 wherein said noble metal is palladium.

10. A process according to claim 1 wherein said hydrogenation of the substantially nitrogen free product is carried out at a temperature ranging from about 300° F. to about 600° F. and is below the temperature at which the hydrodenitrification is carried out, a pressure ranging from about 500 psig to about 4000 psig, and an LHSV ranging from about 0.1 $hr.^{-1}$ to about 2 $hr.^{-1}$ and a substantial hydrogen partial pressure.

11. A process according to claim 10 wherein said LHSV ranges from about 0.1 $hr.^{-1}$ to about 0.5 $hr.^{-1}$.

12. A process according to claim 11 wherein said LHSV is about 0.25 $hr.^{-1}$.

13. A process according to claim 1 wherein the hydrodenitrification catalyst is a sulfided catalyst comprising nickel and molybdenum on an alumina support and said hydrodenitrification process is carried out at a temperature of about 725° F., a pressure of about 2000 psig and an LHSV of about 0.25 $hr.^{-1}$; and said catalyst having hydrogenation activity comprises palladium on a siliceous support and said hydrogenation is carried out at a temperature of about 400° F. and an LHSV of about 0.25 $hr.^{-1}$.

14. A process according to claim 13 wherein said nitro-aromatic-containing stock is a dewaxed hydrocracked bright stock derived from a vacuum residuum fraction of a topped crude oil.

* * * * *